US006235237B1

(12) United States Patent
Osing et al.

(10) Patent No.: US 6,235,237 B1
(45) Date of Patent: May 22, 2001

(54) STEEL ALLOY FOR GLIDING ELEMENTS

(75) Inventors: Heinz Jurgen Osing; Klaus Peter Rittinghaus, both of Iserlohn; Gisbert Kloss-Ulitzka, Neuenrade, all of (DE)

(73) Assignee: Stahlwerk Ergste Westig GmbH, Schwerte (DE)

( * ) Notice: Subject to any disclaimer, the term of this patent is extended or adjusted under 35 U.S.C. 154(b) by 0 days.

(21) Appl. No.: 09/257,395

(22) Filed: Feb. 25, 1999

(30) Foreign Application Priority Data

Feb. 27, 1998 (DE) ..... 198 08 276

(51) Int. Cl.[7] ..... C22C 38/22
(52) U.S. Cl. ..... 420/67; 420/69
(58) Field of Search ..... 420/67, 69, 61

(56) References Cited

U.S. PATENT DOCUMENTS 3,595,643 * 7/1971 Boyce et al. ..... 420/67
5,714,114 * 2/1998 Uehara ..... 148/325

FOREIGN PATENT DOCUMENTS 53-103918 * 9/1978 (JP) ..... 420/67
9/6580 * 3/1982 (RU) ..... 420/67

* cited by examiner

*Primary Examiner*—Deborah Yee
(74) *Attorney, Agent, or Firm*—Merchant & Gould P.C.

(57) ABSTRACT

A chromium steel alloy with 0.2 to 0.65% of carbon, 12.0 to 20.0% of chromium, 0.3 to 5.0% of molybdenum, 0.02 to 0.4% of nitrogen, up to 2% of manganese, up to 1.4% of silicon, up to 2% of nickel, up to 0.5% of copper, up to 0.2% of vanadium and/or niobium and up to 0.1% of aluminum, the remainder being iron including impurities resulting from smelting, is suitable as a material for gliding elements of sports equipment, in particular winter sports equipment.

9 Claims, No Drawings

STEEL ALLOY FOR GLIDING ELEMENTS

The invention relates to a material for gliding elements of sports equipment, in particular for gliding edges of winter sports equipment such as, for example, skis, skibobs and toboggans.

Such materials are subject to extremely diverse stresses; they require high surface quality, in particular high glidability and high wear resistance, overall stability and corrosion resistance and a low tendency to vibration or good damping properties.

A high wear resistance and corrosion resistance reduce the need for regrinding the edges, whereas the straight-line property and/or distortion resistance is of decisive importance when fitting the edges to, for example, the ski. Finally materials for gliding elements and gliding edges require good workability, in particular a good deformation behavior, so that they can be economically produced by rolling or drawing.

For the production of ski edges having an L-shaped cross section by rolling or drawing, German Offenlegungsschrift 2,204,270 proposes the use of a quenchable and temperable steel, whose use properties are adjusted after the quenching and tempering by a special heat treatment. This heat treatment consists of a pearlitization of the flank embedded in situ into the body of the ski underneath the gliding surface, while retaining the martensitic head. To achieve this, heating of the flank to a temperature above the annealing temperature and simultaneous cooling of the head are necessary. In this way, a ski edge head having a high hardness and a relatively soft flank results, which ensures a correspondingly low tool wear during the subsequent stamping-out of recesses.

This heat treatment involves, however, the disadvantage that, as a consequence of the one-sided heating, curvatures, that is to say so-called sickle deviations, occur and this is to be ascribed to a volume contraction during the conversion of the originally martensitic microstructure of the profile flank into the pearlitic state.

In order to avoid the occurrence of sickle deviations, German Offenlegungsschrift 4,218,099 limits the deviation in the Rockwell hardness over the cross section and over the length of the ski edge profile in the hardened and annealed state to less than 2 HRC and, for the pearlitization, prescribes a uniform heat input and, after the pearlitization, deforming of the heat-treated edge profile by bending. The deformation by bending is intended to stretch the flank uniformly, in order to eliminate in this way the curvatures resulting from the partial heat treatment.

The abovementioned process is extremely expensive and frequently does not achieve the desired effect, because it is extremely difficult to achieve the required uniformity of the hardness across the width and length of the profile and a uniform degree of bending stretching over the length of the flank. Furthermore, the quenching and tempering steels being used are not corrosion resistant and therefore require frequent regrinding.

In a process known from German Offenlegungsschrift 4,000,744 for the heat treatment in situ, the ski edge is austenitized by means of a laser beam at temperatures above 700° C., and the austenite is transformed into martensite during cooling. The in-situ heating requires, however, careful cooling of the body of the ski which in most cases consists of plastic and is glued, for example laminated. For this purpose, copper wheels running alongside during the austenitization are used for removing the heat in the edge/body region. This also involves difficulties because, in spite of the heat removal, it is not suitable for every plastic or adhesive for the production of skis, because of the remaining residual quantities of heat. Moreover, the stability of the microstructure is relatively low and internal strains which can be the cause of edge break-outs under lateral impact stress, and distortion can occur.

Furthermore, Swiss patent specification 682,492 proposes the use of a wire using a nitride layer which, in the course of a subsequent deformation, is adjusted to an austenitic microstructure and finally heat-treated. When the wire is transformed into the edge profile, the thickness of the nitride layer decreases and there is a risk of the remaining thickness being too small and the layer tearing apart locally.

The known processes are all in all very involved and frequently also do not lead to reproducible properties. The invention is therefore based on the problem of finding a material which is suitable for the production of gliding elements, in particular ski edges and snowboard edges, and possesses an advantageous combination of properties.

The solution of this problem consists in a chromium steel alloy with 0.2 to 0.65% of carbon
12.0 to 20.0% of chromium
0.3 to 5.0% of molybdenum
0.02 to 0.4% of nitrogen
up to 2% of manganese
up to 1.4% of silicon
up to 2% of nickel
up to 0.5% of copper
up to 0.2% of vanadium and/or niobium and
up to 0.1% of aluminum,
the remainder being iron including impurities resulting from smelting.

The steel alloy according to the invention has, after a heat treatment, a high hardness and wear resistance and also excellent vibration behavior with an effective damping factor of $\eta_{300}<0.5$ coupled with high corrosion resistance, in particular toward chlorides and nitrates. The reason for this is in particular the simultaneous presence of carbon, nitrogen and molybdenum. This applies especially to a chromium steel alloy with 0.30 to 0.50% of carbon
15.0 to 18.5% of chromium
0.5 to 2.5% of molybdenum
0.03 to 0.15% of nitrogen
0.15 to 1.60% of manganese
0.10 to 0.90% of silicon
0.40 to 1.30% of nickel
up to 0.3% of copper
up to 0.1% of vanadium and/or niobium and
up to 0.05% of aluminum,
the remainder being iron including impurities resulting from smelting.

Preferably, the composition of the chromium steel alloy according to the invention satisfies the following condition:

$$(0.05 \text{ to } 0.25)\cdot([\%C]+6[\%N])=(\%\ Mo)/(\%Cr)$$

The heat treatment comprises heating at 1000–1100° C. in a preferably continuous furnace installation with subsequent cooling, while at the same time suppressing precipitation of carbide precursors. The desired working hardness is adjusted by a subsequent heat treatment in the temperature range of 200–600° C., and this serves to suppress the precipitation of carbide precursors.

The invention is based on the discovery that, in the case of certain chromium steel alloys, not only improved hardenability and microstructure homogeneity can be obtained by means of molybdenum and nitrogen, but also a substantially improved effective damping factor $\eta_{300}$. This results from the decrease in the amplitude of the development curve of the ski edge vibration after a measurement period of 300 ms corresponding to the equation $$\eta_{300}=\gamma_{300}/\gamma_0$$

where $\gamma_o$ is the initial amplitude at the start of the vibration.

Whereas the effective damping factors of conventional ski edge materials are in the region of 0.6 to 0.7, they are reduced in the chromium steel alloy according to the invention to less than 0.5. The reason for this are the fine-grain character and the homogeneous distribution of the carbides and carbonitrides as well as the composition of the basic microstructure, determined by the relatively high contents of molybdenum and nitrogen.

The invention is explained in more detail below by reference to illustrative embodiments.

Steel alloys A2 to A5 according to the invention were rolled out to give ski edge profiles and then adjusted by the abovementioned heat treatment to a hardness of 40 to 50 HRC. Conventional materials A1 and B1 to B3 were rolled and heat-treated in the same way; their hardness was about 45 to 49 HRC.

The wear susceptibility δ given in the table was determined by means of the grinding wheel method. In the table, the measured removal of material after a grinding distance of 2000 m is indicated.

| | C (%) | Cr (%) | Mo (%) | Ni (%) | Mn (%) | Si (%) | Cu (%) | Al (%) | V (%) | N (%) | Hardness (HRC) | δ | Determination of corrosion | $\eta_{300}$ |
|---|---|---|---|---|---|---|---|---|---|---|---|---|---|---|
| A1 | 0.35 | 13.5 | — | 0.1 | — | — | — | — | — | <0.03 | 45 | 23 | – | 0.59 |
| A2 | 0.40 | 15.8 | 1.25 | 0.60 | 0.35 | 0.28 | 0.15 | <0.01 | — | 0.05 | 47 | 16 | + | 0.24 |
| A3 | 0.35 | 15.5 | 1.6 | — | 0.10 | 0.35 | 0.10 | <0.01 | — | 0.15 | 46 | 15 | + | 0.25 |
| A4 | 0.45 | 17.5 | 2.1 | — | — | — | 0.15 | 0.10 | — | 0.15 | 48 | 13 | + | 0.28 |
| A5 | 0.50 | 17.0 | 2.0 | — | — | — | — | 0.05 | 0.1 | — | 50 | 12 | + | 0.29 |
| B1 | 0.45 | — | — | — | 0.7 | 0.3 | — | — | — | — | 49 | 16 | – | 0.63 |
| B2 | 0.65 | — | — | — | 0.61 | not determined | — | — | — | — | 47 | 17 | – | 0.69 |
| B3 | 0.68 | <0.1 | — | — | 0.50 | not determined | — | — | — | <0.01 | 48 | 17 | – | 0.71 |

The data in the table show that, in the steel alloys A2 to A5, the hardness, the wear resistance and the vibration damping are, as a consequence of the contents of carbon, nitrogen, molybdenum and chromium according to the invention, substantially improved as compared with the steel alloys B1 to B3.

What is claimed is:

1. Chromium steel alloy having high glidability and wear resistance, overall stability and corrosion resistance and good damping properties, and consisting of 0.2 to 0.65% carbon, 15.0 to 20.0% chromium, 0.5 to 2.5% molybdenum, 0.03 to 0.15% nitrogen, up to 2% manganese, up to 0.9% silicon, up to 2% nickel, up to 0.5% copper, up to 0.2% vanadium and/or niobium, and up to 0.1% aluminum, the remainder being iron including impurities resulting from smelting.

2. Steel alloy according to claim 1 consisting of 0.30 to 0.50% carbon, 15.0 to 18.5% chromium, 0.5 to 2.5% molybdenum, 0.03 to 0.15% nitrogen, 0.15 to 1.60% manganese, 0.10 to 0.90% silicon, 0.40 to 1.30% nickel, up to 0.3% copper, up to 0.1% vanadium and/or niobium, and up to 0.05% aluminum, the remainder being iron including impurities resulting from smelting.

3. Steel alloy according to claim 1, whose contents of carbon, nitrogen, molybdenum and chromium satisfy the following condition:

$$(0.05 \text{ to } 0.25)\cdot([\%C]+6[\%N])=(\%\ Mo)/(\%Cr).$$

4. Steel alloy according to claim 2, whose contents of carbon, nitrogen, molybdenum and chromium satisfy the following condition.:

$$(0.05 \text{ to } 0.25)\cdot([\%N])=(\%\ Mo)/(\%Cr).$$

5. Gliding element for sports equipment comprising a steel alloy according to claim 1.

6. Gliding element for sports equipment comprising a steel alloy according to claim 2.

7. Gliding element for sports equipment comprising a steel alloy according to claim 3.

8. Steel alloy according to claim 1 consisting of 0.35 to 0.50% carbon, 15.5 to 17.5% chromium, 1.25 to 2.1% molybdenum, 0.03 to 0.15% nitrogen, up to 0.60% nickel, up to 0.35% of manganese, up to 0.35% silicon, up to 0.15% copper, 0.05 to 0.1% aluminum, and up to 0.1% vanadium, the remainder being iron including impurities resulting from smelting.

9. Gliding element for sports equipment comprising a steel alloy according to claim 8.

* * * * *